US009193418B1

(12) United States Patent
Brelsford

(10) Patent No.: US 9,193,418 B1
(45) Date of Patent: Nov. 24, 2015

(54) MOORING DEVICE

(71) Applicant: Loren Brelsford, Lewis Center, OH (US)

(72) Inventor: Loren Brelsford, Lewis Center, OH (US)

(73) Assignee: Loren Brelsford, Lewis Center, OH (US)

( * ) Notice: Subject to any disclaimer, the term of this patent is extended or adjusted under 35 U.S.C. 154(b) by 85 days.

(21) Appl. No.: 14/282,388

(22) Filed: May 20, 2014

(51) Int. Cl.
*B63B 21/00* (2006.01)
*B63B 59/02* (2006.01)

(52) U.S. Cl.
CPC ..... *B63B 21/00* (2013.01); *B63B 59/02* (2013.01)

(58) Field of Classification Search
CPC ..... B63B 21/00; B63B 21/04; B63B 21/54; B63B 2021/00; B63B 2021/03; B63B 2021/04; B63B 2021/20; B63B 59/02
USPC ..... 114/230.1, 230.2, 230.25, 230.26, 114/230.27, 230.28, 230.29, 230.3
See application file for complete search history.

(56) References Cited

U.S. PATENT DOCUMENTS

| | | | |
|---|---|---|---|
| 675,318 | A | 5/1901 | Boothe |
| 929,952 | A | 8/1909 | Johnson |
| 1,093,096 | A | 4/1914 | Allen |
| 1,617,556 | A | 2/1927 | Vineberg |
| 2,413,210 | A | 12/1946 | Blackman |
| 2,424,635 | A | 7/1947 | Schwall |
| 2,497,030 | A | 2/1950 | Lewis |
| 2,808,016 | A | 10/1957 | Jarnot |
| 2,938,492 | A | 5/1960 | Kulick |
| 2,965,064 | A | 12/1960 | Wallace |
| 3,081,731 | A | 3/1963 | McEvoy |
| 3,120,831 | A | 2/1964 | Fulton |
| 3,122,120 | A | 2/1964 | Jorgenson |
| 3,224,404 | A | 12/1965 | Jong |
| 3,389,675 | A | 6/1968 | Kieft et al. |
| 3,401,413 | A | 9/1968 | Anselmi |
| 3,442,245 | A | 5/1969 | Christians et al. |
| RE27,050 | E | 2/1971 | Jorgenson |
| 3,695,209 | A | 10/1972 | Giese |
| 3,757,370 | A | 9/1973 | Seno et al. |
| 3,951,384 | A | 4/1976 | Hildreth |
| 3,993,013 | A | 11/1976 | Nunziato et al. |
| 4,022,450 | A | 5/1977 | Smith, Jr. |

(Continued)

FOREIGN PATENT DOCUMENTS

| | | |
|---|---|---|
| DE | 3504142 | 8/1986 |
| FR | 2650805 | 2/1991 |

(Continued)

OTHER PUBLICATIONS

Tideminders: Resources; www.tideminders.com/resources.htm; (Aug. 29, 2008).

(Continued)

*Primary Examiner* — Daniel V Venne
(74) *Attorney, Agent, or Firm* — Hahn, Loeser & Parks, LLP; Rex W. Miller, II

(57) ABSTRACT

A portable water level-responsive mooring device has a mooring strap capable of engaging the mooring device around a dock piling, a cleat strap that secures the mooring device to an associated water vessel, a fender attached to the mooring device to protect against dock piling impact, and a link securing mooring device components together for operation.

13 Claims, 14 Drawing Sheets

(56) References Cited

U.S. PATENT DOCUMENTS

| | | | | |
|---|---|---|---|---|
| 4,376,419 | A | 3/1983 | Heilskov | |
| 4,480,576 | A | 11/1984 | Mills | |
| 4,627,375 | A | 12/1986 | Davis et al. | |
| 4,843,994 | A * | 7/1989 | Wilson | E02B 3/26 114/219 |
| 4,912,816 | A | 4/1990 | Brandt | |
| 5,050,521 | A | 9/1991 | Stone | |
| 5,265,553 | A | 11/1993 | Brydges | |
| 5,361,716 | A | 11/1994 | Cotton | |
| 5,441,006 | A | 8/1995 | Wood | |
| 5,467,727 | A | 11/1995 | Godvin et al. | |
| 5,603,280 | A | 2/1997 | Shackelford, Jr. | |
| 5,634,421 | A | 6/1997 | Velarde | |
| 5,762,016 | A | 6/1998 | Parsons | |
| 5,937,781 | A | 8/1999 | Isella et al. | |
| 6,062,158 | A | 5/2000 | Blanchard | |
| 6,216,625 | B1 | 4/2001 | Baluha | |
| 6,273,017 | B1 * | 8/2001 | Griffin | B63B 21/54 114/221 R |
| 6,390,009 | B2 | 5/2002 | Brown et al. | |
| 6,532,885 | B1 | 3/2003 | Cordoba | |
| D473,508 | S | 4/2003 | Mastrofilipo, Jr. | |
| 6,994,047 | B1 | 2/2006 | Pent, III | |
| 7,021,230 | B1 | 4/2006 | Lawrence | |
| 7,188,579 | B2 | 3/2007 | Lenonides | |
| D593,924 | S | 6/2009 | Newmark | |
| 7,921,791 | B2 | 4/2011 | Brelsford | |
| 8,291,847 | B2 | 10/2012 | Brelsford | |
| 2006/0060124 | A1 | 3/2006 | DiCampli | |

FOREIGN PATENT DOCUMENTS

| | | |
|---|---|---|
| FR | 2683788 | 5/1993 |
| GB | 1409243 | 10/1975 |
| SU | 712320 | 1/1980 |
| SU | 1454776 | 1/1989 |

OTHER PUBLICATIONS

Tideminders Instructions (2 pages) (enclosed with product purchased Aug. 2008).

* cited by examiner

MOORING DEVICE

BACKGROUND AND SUMMARY OF THE INVENTION

The present disclosure relates to portable docking systems, and more particularly to portable docking systems that accommodate the rise and fall of water levels.

Captains of boats and other vessels that navigate waterways should take the rise and fall of the water levels into account. For example, along some shore lines, the water level varies greatly between high tide and low tide. The geographic shape of the shoreline may contribute to how much the water level varies. In some locations, the difference between the water level at high tide and the water level at low tide can be as much as 16 meters. In other areas, the difference between the water level at high tide and the water level at low tide can be as little as a few centimeters. More generally, the water level may vary between about 1 to 2 meters between high and low tide.

The captain of a boat considers the current water level and possible future water levels when docking a vessel. If the captain secures the boat tightly to a dock at high tide, in as little as two hours the boat could be hanging from the dock with little water beneath it, causing damage to the boat and to the dock. For this reason, many boaters have to continuously readjust their mooring to keep their boat level as the water level changes. This causes great inconvenience for the captain of the vessel, who may have to return to the boat every 20 or 30 minutes.

Further, the water along the docks may be choppy as surface waves reach the shore. The wake from other boats cause further waves that cause a docked boat to bob alongside the dock. Some waves are large enough to propel a boat against a dock or another boat with great force, causing damage to the dock and boat. Thus, the captain must secure the boat tightly against the dock to hold the boat in place against wave forces.

In addition to securing a boat to the dock piling, the boat may need to be cushioned against wave forces. Generally, wave forces may cause the boat to come into contact with the dock pilings. In order to prevent damage to a boat, there is a need for a structure such as a fender to cushion the impact of between the boat and dock piling.

The need to secure the boat against wave forces can be contrary to the need to allow the boat to freely rise and fall with the water level during high and low tide. For inexperienced boaters, it may be particularly difficult to balance these opposing requirements. If a mooring line is left loose enough to allow the boat to drop 2 meters with the tide, the 2 meters of slack will allow the waves to cast the boat against the dock, creating the potential for damage. If the mooring secures the boat to the dock, the boat may be unable to move when the tide changes, creating the potential for damage.

Successfully securing a boat to a dock may be time consuming and inconvenient, depending on the experience of the captain of the boat. Although spring lines may be employed as a means for mooring boats, such devices involve complicated arrangements of lines and may be difficult for amateur or inexperienced boaters to use. Furthermore, the time required to set spring lines correctly, even for an experienced boater, may be inconvenient. Even after spring lines are initially configured, the captain of the boat may still need to adjust the lines to accommodate the rising and falling of the water level or to prevent interference with existing dock lines.

Various docking systems are known in the art that attempt to solve these problems. Docking systems are available for permanent installation at a dock providing a mechanism that moves vertically with the water level, but is securely attached to the dock. But this is not a satisfactory solution for the captain of a vessel who wishes to temporarily dock during an outing, such as docking along-side a work-site, a cargo dock, a restaurant, a recreation area, or any other temporary and short term docking situation. There remains a need in the art for a mooring device that securely moors a vessel to a dock yet accommodates the changing water level of the body of water.

The portable water level-responsive mooring device comprises a mooring strap comprising a length of cord, the length of cord being sufficient to wrap around a dock piling; a ring removeably affixed to one end of the mooring strap; a clip removably affixed to an opposite end of the mooring strap, the clip capable of releasably attaching to the ring; a plurality of spacing tubes; and a plurality of rollers having an outer diameter greater than the outer diameter of the spacing tubes and an aperture axially positioned there through, the cord positioned within an arrangement of the spacing tubes and rollers.

The portable water level responsive mooring device also comprises a method of securing a vessel to a dock piling and responding to a water level that comprises providing a portable water level-responsive dock securing system comprising a mooring strap comprising a length of cord having a ring on one end capable of releasably attaching to a clip on an opposite end, a plurality of spacing tubes and a plurality of rollers having an outer diameter greater than the outer diameter of the spacing tubes and an inner diameter larger than the outer diameter of the cord, the cord positioned within an arrangement of the spacing tubes and the rollers, the length of cord being sufficient to wrap around a dock piling; wrapping the mooring strap around the dock piling; attaching each mooring strap clip to the ring such that the vessel is adjacent the dock piling; and translating the mooring strap along the dock piling by the rollers as a water level changes.

The portable water level-responsive mooring device also comprises a cleat strap comprising a cord having a loop capable of engaging a boat cleat and a ring opposite the loop; a mooring strap comprising a length of cord having a clip on each end capable of releasably attaching to the ring, a plurality of spacing tubes, and a plurality of rollers having an outer diameter greater than the outer diameter of the spacing tubes and an inner diameter larger than the outer diameter of the cord, the cord positioned within an arrangement of the spacing tubes and the rollers, the length of cord being sufficient to wrap around a dock piling; and a fender having a clip capable of releasably attaching to the ring. The dock securing system further comprises an extension strap comprising a cord having an extension strap clip on one end and an extension ring on another end, the extension clip capable of releasably attaching to the extension ring to form a loop capable of receiving one or more mooring strap clips, the extension strap clip capable of releasably attaching to a cleat strap ring.

The portable water level responsive mooring device may also comprise a cleat strap comprising a cord having a loop at one end configured for engaging a boat cleat and a link connector at an opposite end of the cord; a mooring strap comprising a length of mooring cord having a link connector on each end, a plurality of spacing tubes, and a plurality of rollers having an outer diameter greater than the outer diameter of the spacing tubes and an inner diameter larger than the outer diameter of the mooring cord, wherein the spacing tubes and the rollers are alternatingly arranged between the ends of the mooring cord, and wherein the mooring cord is positioned within respective apertures of the spacing tubes and the rollers, the length of the mooring cord being sufficient to wrap around a dock piling; a fender having a link connector; and a link, comprising a cleat catch assembly adapted to secure a link connector from an associated cleat strap, a mooring catch assembly adapted to secure at least one link connector from an associated mooring strap, and a fender catch assembly adapted to secure the link connector of an associated fender.

The portable water level responsive mooring device may also comprise a cleat strap with a cord having a loop at one end configured for engaging a boat cleat and a cleat strap ring at an opposite end of the cord; a mooring strap comprising a length of mooring cord having a clip on each end releasably attached to the cleat strap ring, a plurality of spacing tubes, and a plurality of rollers having an outer diameter greater than the outer diameter of the spacing tubes and an inner diameter larger than the outer diameter of the mooring cord, wherein the spacing tubes and the rollers are alternatingly arranged between the ends of the mooring cord, and wherein the mooring cord is positioned within respective apertures of the spacing tubes and the rollers, the length of the mooring cord being sufficient to wrap around a dock piling; and a fender having a fender clip releasably attached to the cleat strap ring, a cord-receiving aperture, a fender linkage assembly comprising a ring, and a fender cord, wherein the cord has a first end, and a second end permanently anchored to the fender linkage assembly, and the cord is wrapped radially around the fender, passed through the fender linkage assembly, wrapped axially around the fender through the aperture, and passed through fender linkage assembly a second time.

DETAILED DESCRIPTION OF THE DRAWINGS

Figure 1:
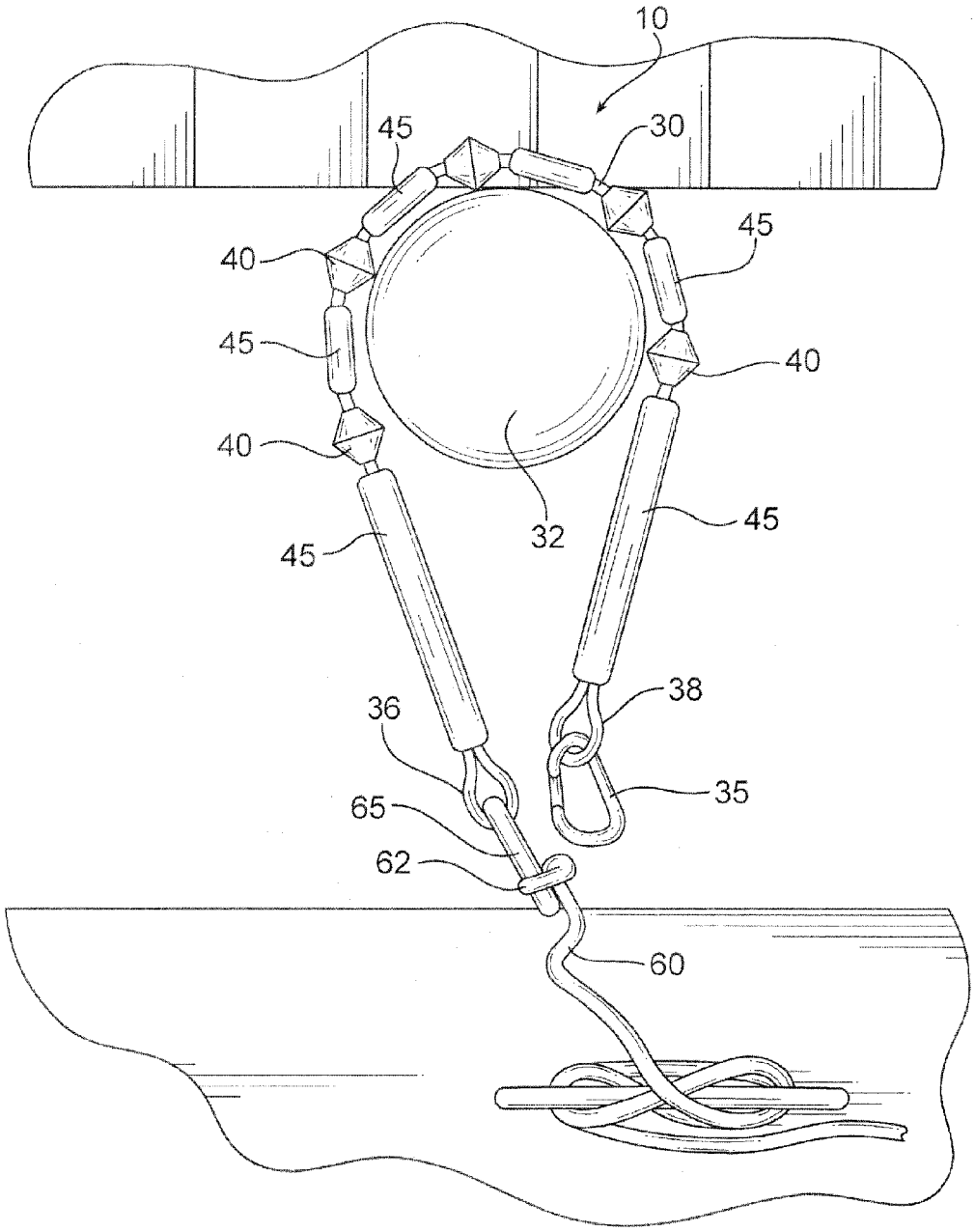
FIG. 1 is a plan view of a mooring device in position around a dock piling before securing a clip.
Figure 2:
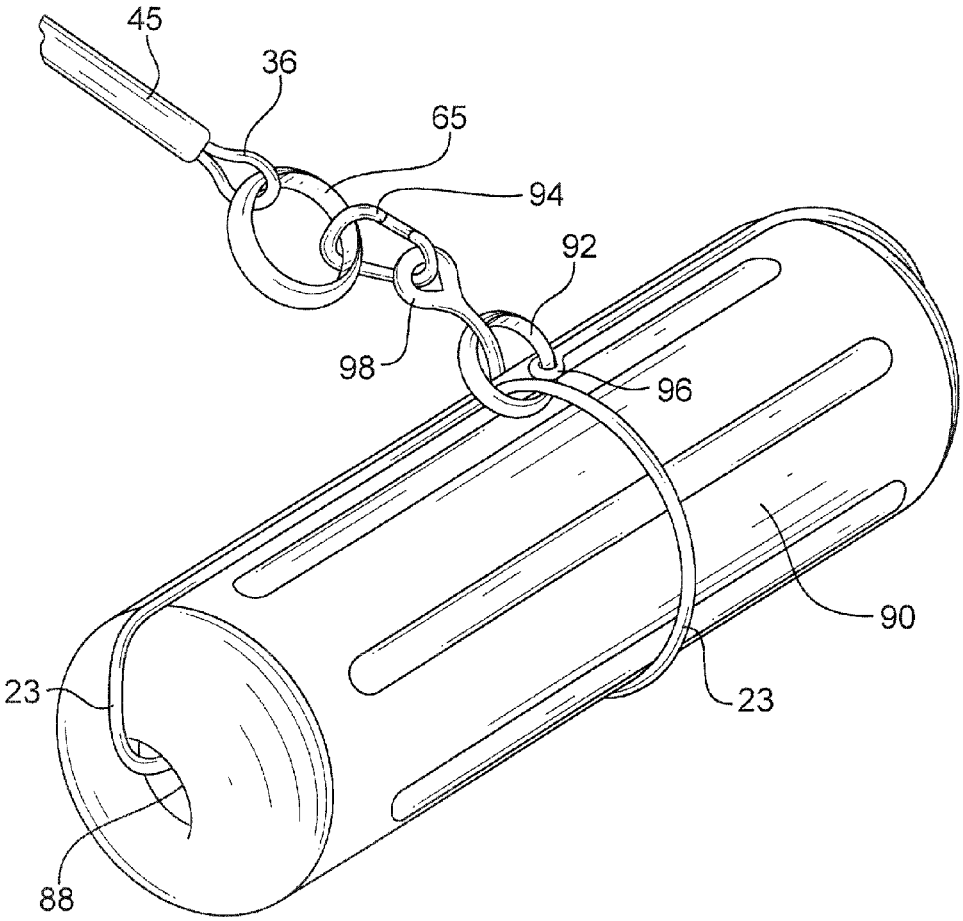
FIG. 2 is a perspective view of the boat fender and fender cord.

Referring now to FIGS. 1 and 2, a portable water level-responsive mooring device or dock securing system has a mooring strap 10 capable of forming a loop around a dock piling 32. The mooring strap 10 may include a ring 65 on one end and a clip 35 on the opposite end of the mooring strap 10. The mooring strap 10 may further include an arrangement of rollers 40 and spacing tubes 45. In the embodiment shown in FIG. 1, the clip 35 releasably attaches to the ring 65 to form a loop around the dock piling 32. The ring 65 may also connect features of the dock securing system, such as rope, an extension strap, a cleat strap, additional clips 35, and a fender 90.

The mooring strap 10 may include a cord 30 having a length sufficient to wrap around a dock piling 32. The ring 65 may be connected to the cord 30 by forming a loop 36 through the ring 65, and the clip 35 may be removably affixed to the opposite end of the cord 30 by forming a loop 38 through the clip 35. The loops 36, 38 may be formed by a rope splice or eye splice in the cord 30. Alternately or in addition, the loops 36, 38 may be formed in the cord using a crimp ring, crimp band, clamp, or other fastener (not shown). Alternately or in addition, loops 36, 38 may comprise a knot. The mooring strap 10 may further include at least two rollers 40, and at least three spacing tubes 45. Alternately, the mooring strap 10 may have at least four rollers 40 and at least five spacing tubes 45 in an arrangement of alternating spacing tubes 45 and rollers 40.

As shown in FIG. 1, the cord 30 may be positioned within various arrangements of the spacing tubes 45 and rollers 40. As shown in the example in FIG. 1, the mooring strap 10 may have an alternating arrangement of rollers 40 and various lengths of spacing tubes 45 as desired. In one alternate, the arrangement of spacing tubes 45 and rollers 40 may comprise a spacing tube 45 followed by two rollers 40, followed by a spacing tube 45. This pattern may be repeated until the mooring strap 10 has a desired number of spacing tubes 45 and rollers 40. In another arrangement, the spacing tubes 45 and rollers 40 may have a spacing tube 45, a plurality of rollers 40, and an additional spacing tube 45. The mooring strap 10 may have any suitable arrangement of rollers 40 and spacing tubes 45. As shown in FIG. 1, the arrangement of spacing tubes 45 and rollers 40 may be such that the lengths of the spacing tubes 45 near the ends of the mooring strap 10 are longer than the spacing tubes between rollers 40. Alternately, the length of the spacing tubes 45 may be any length to correspond with a desired arrangement of spacing tubes 45 and rollers 40. The length of the spacing tubes 45 may vary according to the length of the mooring strap 10 and the number of rollers 40 desired.

Figure 7:
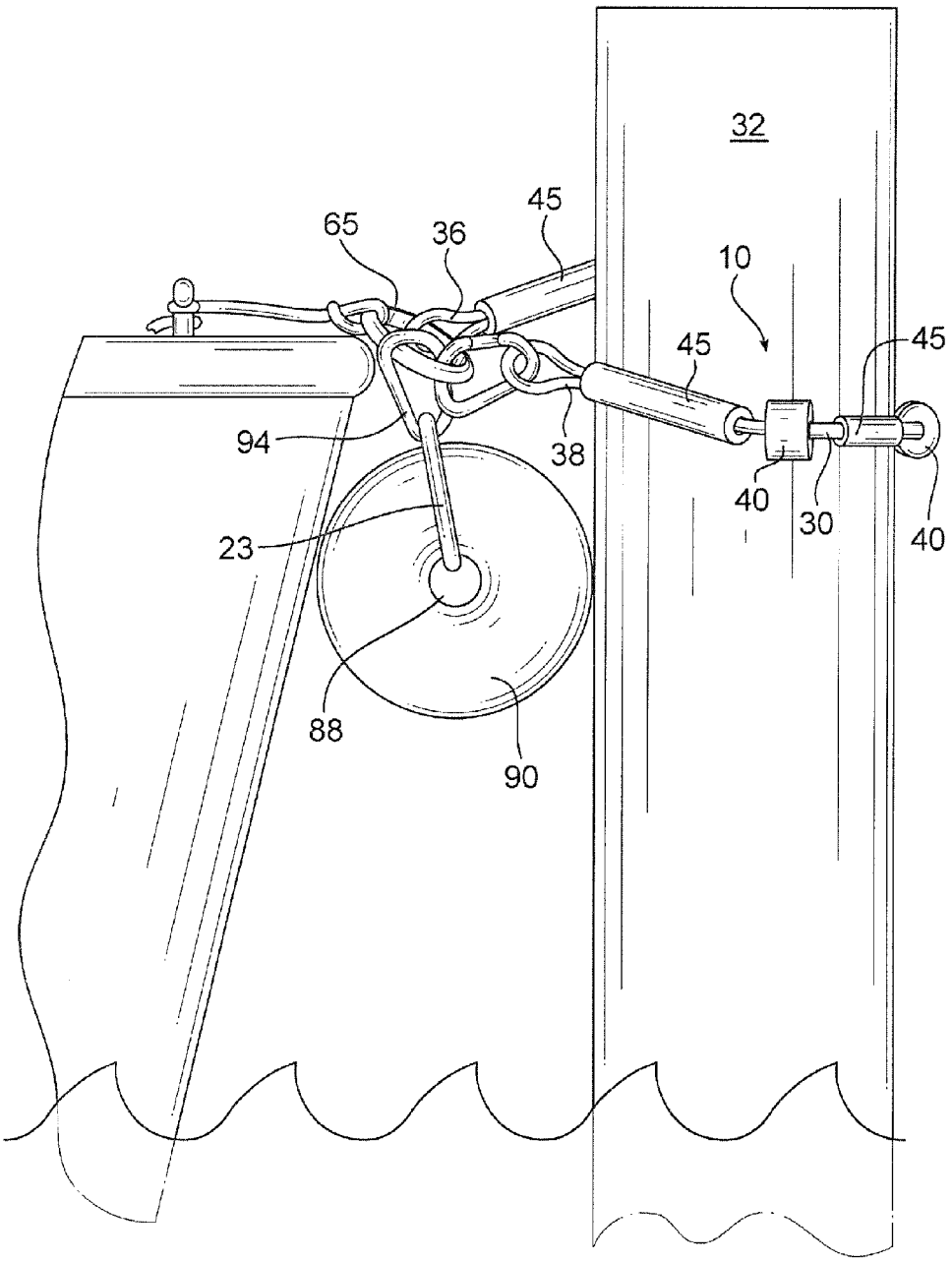
FIG. 7 is a side elevational view of the mooring device mooring a vessel to a dock piling.
Figure 8:
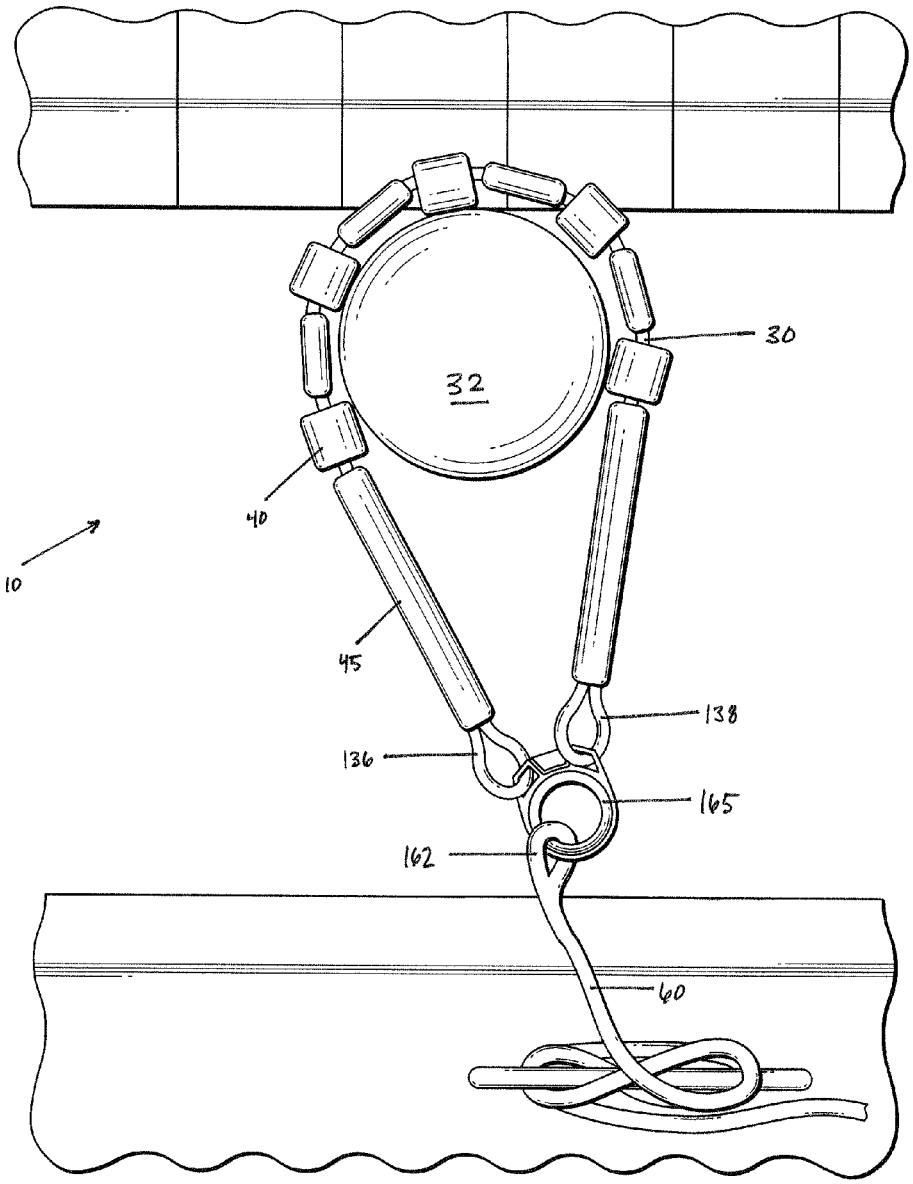
FIG. 8 is a plan view of a mooring device in position around a dock piling and secured to a link.
Figure 9:
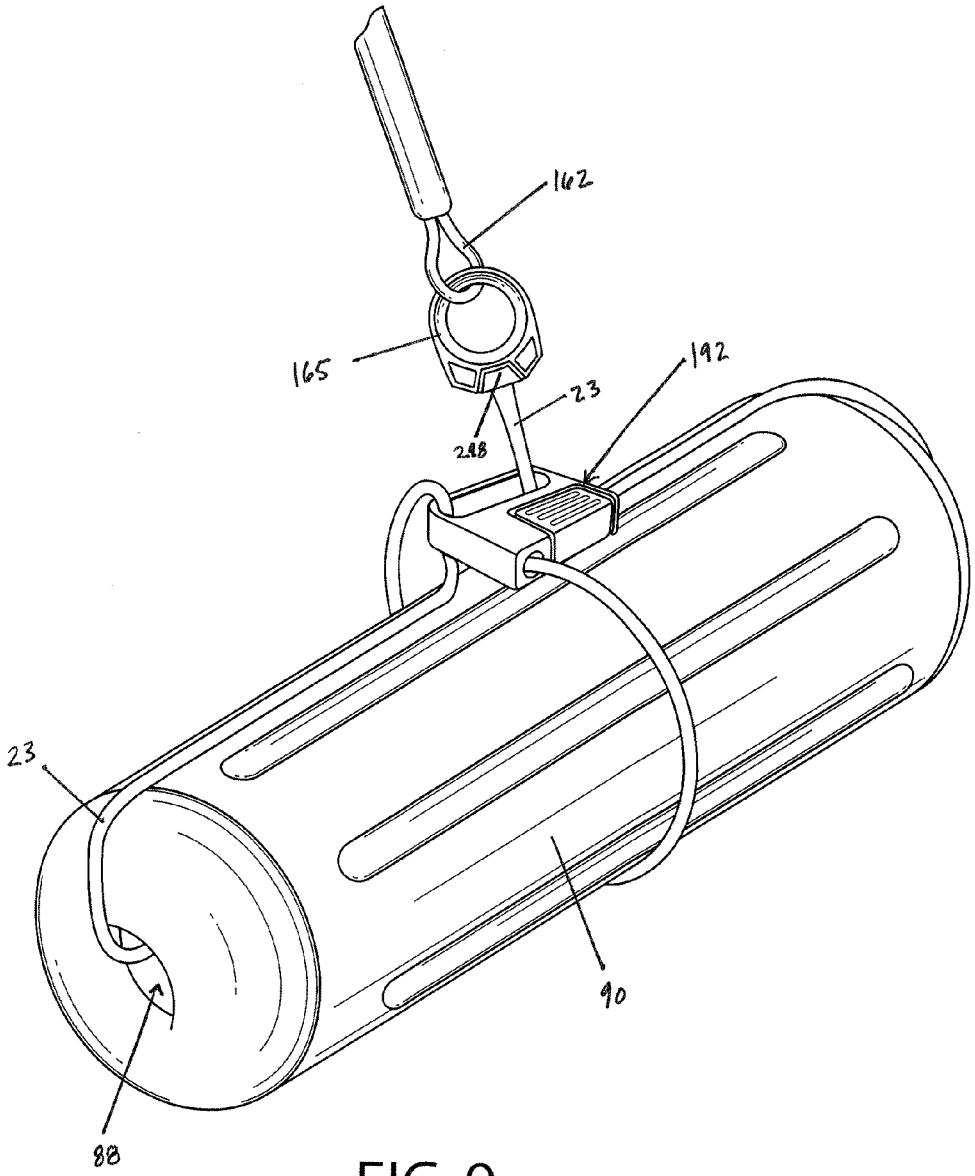
FIG. 9 is a perspective view of the boat fender, fender linkage assembly, fender cord and link.

The mooring device may include a fender capable of protecting the boat from contacting the dock or dock piling. The fender may be cylindrical, spherical, spheroidal, or other suitable shape for a fender. As shown in FIGS. 2 and 7, a fender 90 may be provided having an axially extending aperture 88 there through. A fender cord 23 may be used to secure the fender 90 to the ring 65 of the mooring strap 10. The fender cord 23 may be constructed from a length of cord of any suitable material such as rope. The fender cord 23 may include a fender ring 92 on one end and a clip 94 removably attached to the opposite end of the fender cord 23. The fender ring 92 may be affixed to the fender cord 23 by forming a loop 96 through the fender ring 92, and the clip 94 may be removably affixed to the opposite end of the fender cord 23 by forming a loop 98 through the clip 94. The loops 96, 98 may be formed by a rope splice or eye splice in the fender cord 23. Alternately or in addition, the loops 96 and 98 may be formed in the cord using a crimp ring, crimp band, clamp, or other fastener (not shown). Alternately or in addition, loops 96, 98 may comprise a knot. In an alternate embodiment, not shown, the fender ring 92 is integrally connected to the fender cord 23, such as formed as a loop, to receive the fender clip 94 in the installed position. In this embodiment, the fender ring 92 may be a small loop or an eye splice, and may be reinforced by an eye thimble, sleeve, or other reinforcement (not shown).

The fender cord 23 may be secured to the fender 90 by extending through the fender in a first loop and around the fender in a second loop transverse to the first loop. As shown in FIG. 2, the fender cord 23 may be secured to the fender 90 by a method comprising the steps of wrapping the fender cord 23 axially around the fender through the aperture 88, passing the cord through the fender ring 92, wrapping the cord radially around the fender, then passing the cord through the fender ring 92 a second time. Stated another way, the length of fender cord 23 extends substantially around the fender 90 along the axis of the aperture 88, and around the fender 90 around the axis of the aperture 88 by passing through the fender ring 92. The fender clip 94 may be removed from the fender cord 23 while securing the fender cord 23 to the fender 90. The clip 94 may be used to releasably attach the fender 90 to the ring 65 or the clip 35 of the mooring strap 10.

Alternately, the fender cord 23 may be secured to the fender 90 such that the fender will hang with the axis of the aperture in an approximately upright orientation. In this configuration, the fender cord 23 may be secured to the fender 90 by a method comprising the steps of wrapping the fender cord 23 axially around the fender through the aperture 88, and passing the cord through the fender ring 92, where the fender ring 92 is positioned approximately in alignment with the aperture. Alternately, when the fender clip 94 is larger than the aperture 88 and cannot pass through the aperture 88, the fender cord 23 may be threaded through the aperture 88 such that the fender 90 is supported by the fender ring 92 when the opposite end of the fender cord is clipped or tied to the mooring device or boat or other location as desired.

The cords 30, 23 may be of any suitable cord, including polymer or natural fiber ropes, metal cable or strap, "bungee" or other elastic bands, and other cordage. The mooring strap cord 30 may be a different material than the fender cord 23. In one embodiment, the cord 30 is constructed from steel cable, such as a steel cable with a protective coating, or a stainless steel cable. In an alternate embodiment, the cords 30, 23 comprise a polymer or natural fiber cordage or rope, such as, but not limited to nylon, polyester, polypropylene, hemp, or cotton. Alternately, the cords 30, 23 may include a core of an elastic and resilient material, for example but not limited to rubber or elastomer. The cords 30, 23 may be covered with a fiber braid, such as but not limited to nylon, polyester, polypropylene, hemp, or cotton.

The rollers 40 may be cylindrical, spherical, spheroidal, or any other suitable shape for a roller having an axial extending aperture there through. The outer diameter of the rollers 40 may be greater than the outer diameter of the spacing tubes 45 and the inner diameter larger than the outer diameter of the cord 30. In this way, the cord 30 may function as an axle and the rollers 40 may rotate around the cord. As shown in FIG. 1, the rollers 40 may have a larger diameter in a center portion than the diameter at one or both ends.

The rollers 40 may be a rigid or semi-rigid material to enable the rollers 40 to translate along a dock piling 32 when in use. The rollers 40 may be made of a material such as for example but not limited to polyvinyl chloride, polyethylene, polypropylene, nylon, stainless steel, or other material. Alternately or in addition, the rollers 40 may be a thermoplastic material having a density between about 0.80 and 1.0 gram per cubic centimeter to float in water. In some embodiments, the rollers 40 may be a foamed material having a density between about 0.40 and 0.90 gram per cubic centimeter.

The spacing tubes 45 may be a tube having an inside diameter greater than or equal to the outer diameter of the cord 30. The spacing tubes 45 are of desired lengths to correspond with a desired arrangement of spacing tubes 45 and rollers 40. Accordingly, the length of the spacing tubes 45 may vary according to the length of the mooring strap 10 and the number of rollers 40 desired. As shown in FIG. 1, the arrangement of spacing tubes 45 and rollers 40 may be such that the lengths of the spacing tubes 45 near the clips 35 is longer than the spacing tubes 45 between rollers 40. The spacing tubes 45 may be made from any suitable material such as for example but not limited to polyvinyl chloride, polyethylene, polypropylene, nylon, stainless steel, or other material.

The clips 35, 80, 94 may be a normally-closed, spring loaded clips. As shown in FIG. 1, the clips 35 may be a carabiner style clip. Alternately, the clip 35 may be a cord clip, snap hook, leash clip, or any style of clip capable of attaching the mooring strap 10 to the ring 65. The clip 35 may also be a lockable clip.

The ring 65 may be a circular or ring shape, but is not limited to such shape. The ring 65 may be elliptical, oval, or other suitable shape.

The clips 35, 80, 94 and the rings 65, 85 may transfer forces caused by water pulling the vessel from the dock piling 32. Accordingly, the clips 35, 80, 94 and the rings 65, 85 may be made of a material capable of securing the vessel to the dock piling 32. The clips 35, 80, 94 and the rings 65, 85 may be made from a material such as for an example, but not limited to, steel, stainless steel, cast iron, aluminum, nylon, acetal, polyester or other suitable thermoplastic or metal materials. The clips 35, 80, 94 and the rings 65, 85 may be attached to the cord 30 by a crimp, crimp ring, crimp band, clamp, or other fastener (not shown). Alternately or in addition, the clips 35, 80, 94 and the rings 65, 85 may be attached to the cord by a rope splice, eye splice, or knot.

Figure 3:
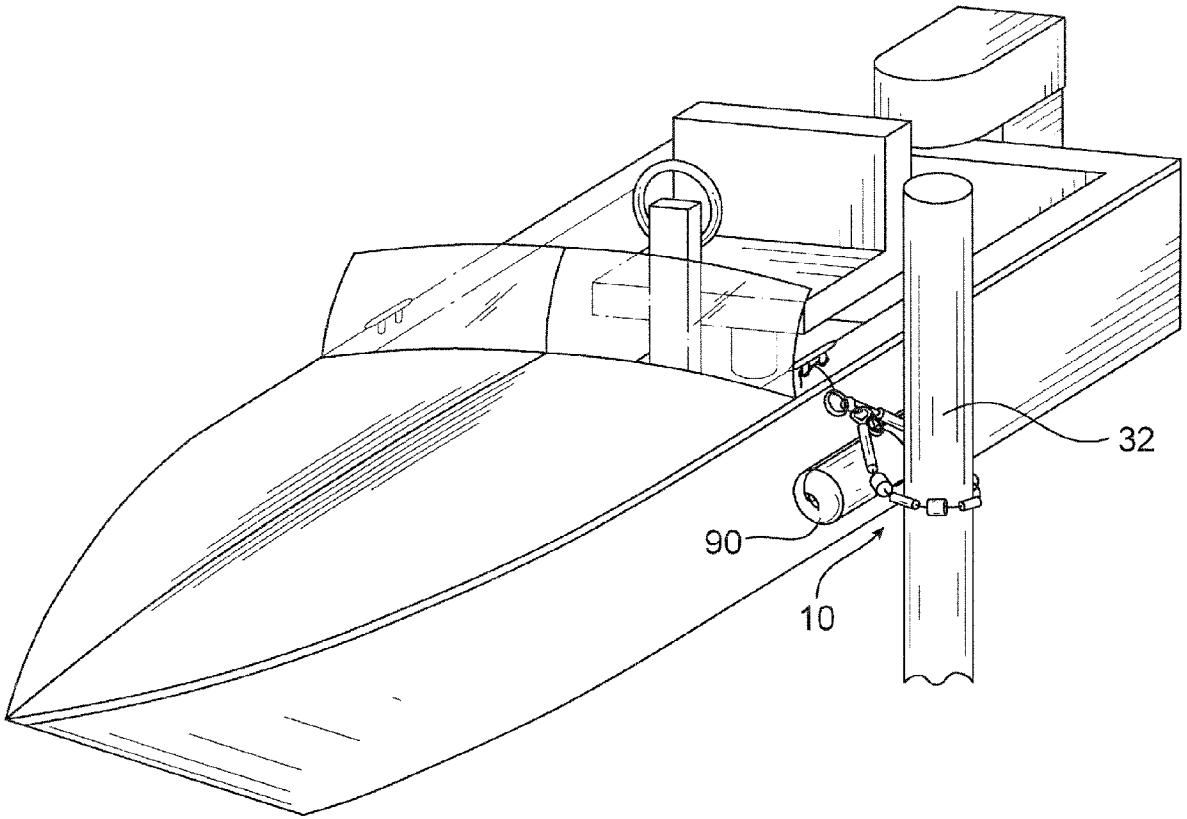
FIG. 3 is a perspective view of the mooring device mooring a vessel to a dock piling.

The method of using the dock securing system may include providing the mooring strap 10 with the ring 65 to connect the mooring strap 10 and fender 90 to the dock piling 32. In operation, the dock securing system may be utilized by the method of wrapping the mooring strap 10 around the dock piling 32 and securing the clip 35 to the loop 38 and to the ring 65. The clip 35 releasably attaches to the ring 65 to form a loop around the dock piling 32 as shown in FIG. 3. The length of the mooring strap 10 may be determined by the circumference of a dock piling 32. The rollers 40 assist the dock securing system in raising and lowering with the change in water level. As the water level changes, the vessel naturally rises and falls with the water level. The vessel pulls on the dock securing system as the vessel changes height relative to the dock, causing the mooring strap 10 to move along the dock piling 32 by the rollers 40 as the water level changes. The fender 90 may also releasably attach the ring 65 of the mooring strap 10 in order to protect the boat from coming into contact with the dock piling 32.

Figure 4:
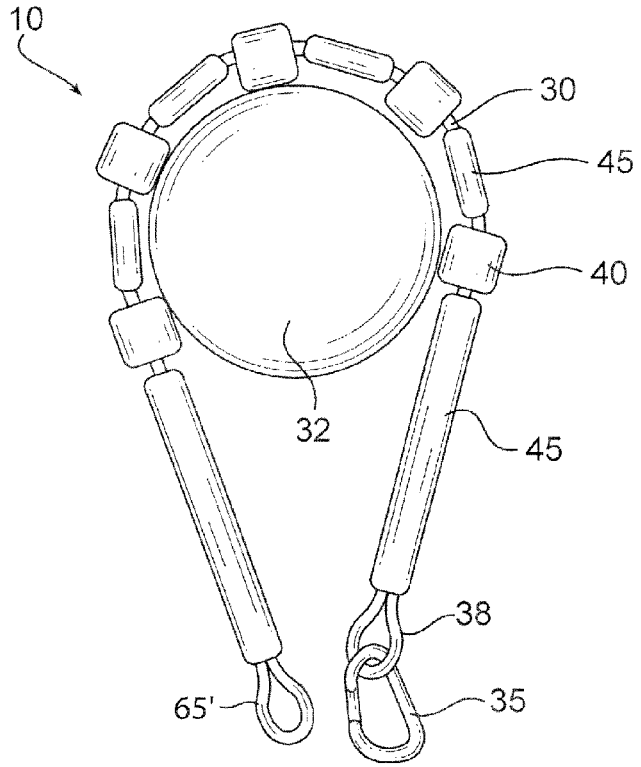
FIG. 4 is a plan view of an alternate configuration of a mooring strap of a mooring device in position around a dock piling before securing a clip.

In an alternate embodiment shown in FIG. 4, the ring 65' is integrally connected to the cord 30, such as formed as a loop, to receive the clip 35 in the installed position. The ring 65' may be a small loop or an eye splice, and may be reinforced by an eye thimble, sleeve, or other reinforcement (not shown). In yet another alternate, not shown, a clip may be used as the ring 65.

Figure 5:
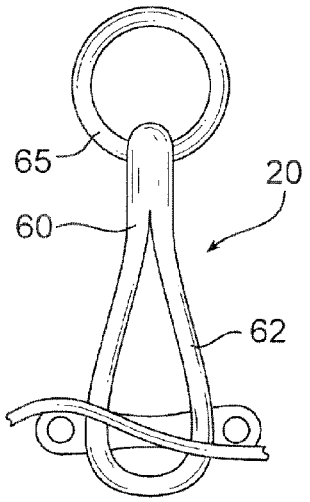
FIG. 5 is an extension strap of the present disclosure.

In some embodiments, the portable water level responsive dock securing system may have a cleat strap 20 as shown in FIG. 5, in addition to the mooring strap 10. The cleat strap 20 may include a cord 60 formed into a loop 62 capable of engaging a boat cleat on one end, and the ring 65 positioned on the cleat strap 20 opposite the loop 62. Alternately, instead of ring 65, a small loop such as an eye splice may be provided (not shown). In yet another alternate, a clip may be provided (not shown). The loop 62 may be formed in the cord by a rope splice or eye splice in the cord 60. Alternately or in addition, the loop 62 may be formed in the cord using a knot, a crimp ring, crimp band, clamp, or other fastener (not shown). The cord 60 may be a steel cable, such as a steel cable with a protective coating or a stainless steel cable. Alternately, the cord 60 may be a length of rope or cordage of nylon, cotton, and may have an elastic core.

One method of using the dock securing system may include wrapping or looping the cleat strap 20 around a boat cleat, wrapping or looping the mooring strap 10 around the dock piling 32, and attaching each mooring strap clip 35 to the cleat strap ring 65 such that the vessel is adjacent the dock piling 32.

Figure 6:
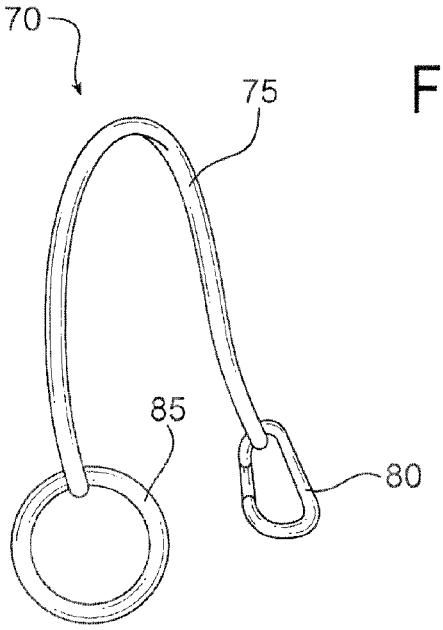
FIG. 6 is a plan view of a cleat strap of the mooring device in position around a boat cleat.

In an additional or alternative embodiment shown in FIG. 6, the portable water level-responsive dock securing system may include an extension strap 70. The extension strap 70 may have a cord 75 having an extension clip 80 on one end, the extension clip 80 capable of releasably attaching to a receiver 85 on the opposite end of the extension strap. The receiver 85 positioned on the end of the extension strap may comprise at least one selected from the group consisting of an extension ring, extension clip, and loop. The extension clip 80 may be capable of releasably attaching to the receiver 85 and/or the ring 65 of the mooring strap.

The alternative or additional method of using the dock securing system may include the steps of releasably attaching each mooring strap clip 35 to the receiver 85 instead of ring 65, and releasably attaching the extension clip 80 into the ring 65 providing an extension distance about the length of the extension strap. Alternately, the extension strap 70 may be folded in half to provide an extension distance about ½ the length of the extension strap 70. When folding the extension strap 70, the extension clip 80 may be fastened into the extension receiver 85 forming a loop. Then, the mooring strap clip 35 may be attached by attaching the mooring strap clip 35 to the extension strap loop or the receiver 85 as desired to form various configurations.

In still other embodiments of the present invention, generally shown in FIGS. 8-23, the portable water level-responsive dock securing system may utilize a link 165 configured to secure various system components during operation. In embodiments, the link 165 includes a cleat catch portion, a fender catch portion, and one or more mooring catch portions. Specifically, as shown in FIGS. 8-12, the link 165, which is a functionally similar but evolved version of the ring 65, may comprise one or more of a cleat catch assembly 262, mooring catch assembly 236, and/or fender catch assembly 298, each of which are adapted to secure, or releasably secure, a link connector of an associated dock securing system component. For example, in various embodiments, the loops 36, 38 of the mooring strap 10 may comprise link connectors 136, 138; the loop 62 of the cleat strap 20 may comprise one or more link connectors 162, 164; and the loops 96, 98 of the fender 90 may comprise one or more link connectors 196, 198. The link 165 facilitates operation of the dock securing system by providing: a cleat catch assembly 262 adapted to secure the link connector 162 from an associated cleat strap 20; a mooring catch assembly 236 configured to secure a link connector, or loops, 136, 138 from an associated mooring strap 10; and a fender catch assembly 298 designed to secure a link connector 198 from an associated fender 90.

Figure 10:
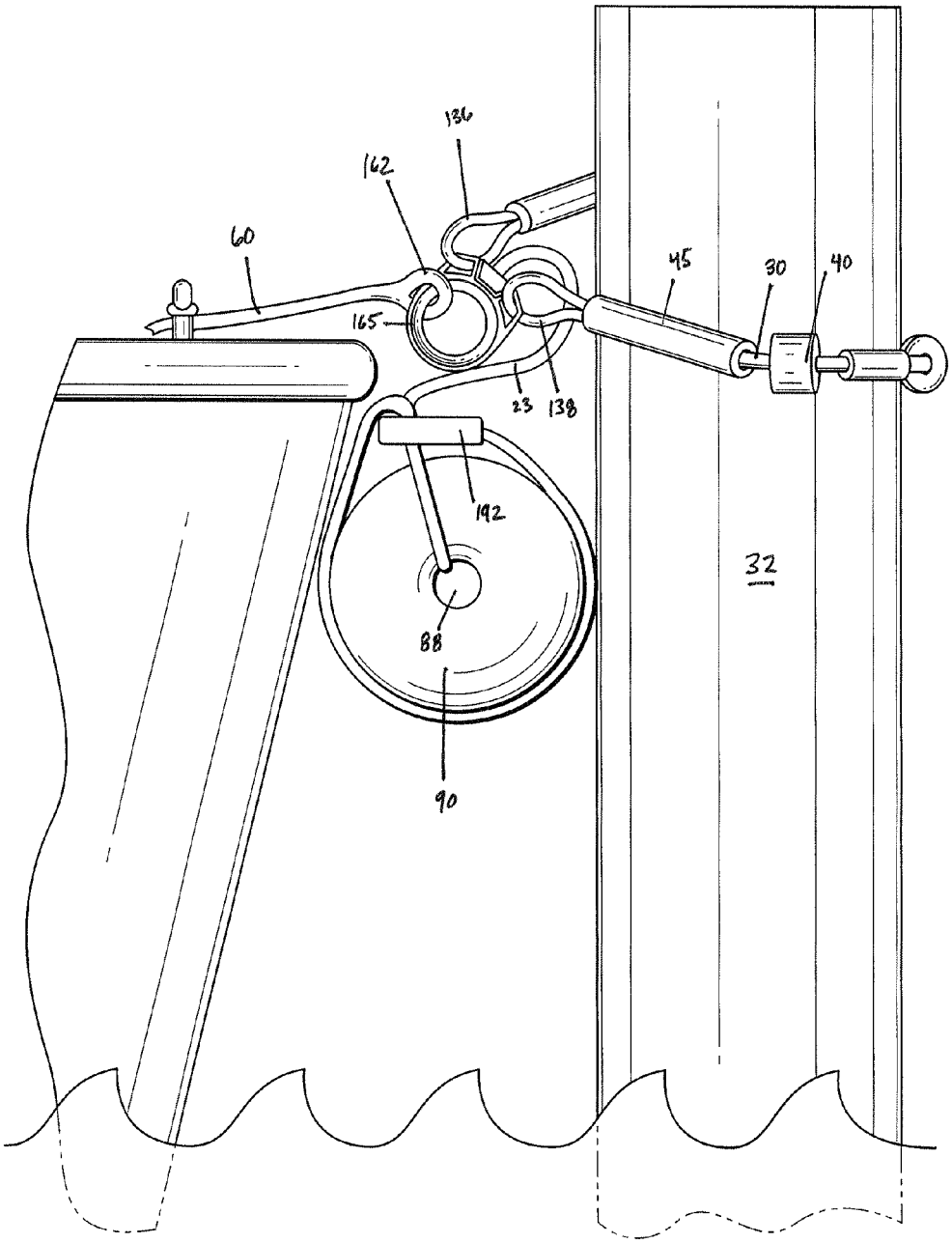
FIG. 10 is a side elevational view of the mooring device mooring a vessel to a dock piling.
Figure 11:
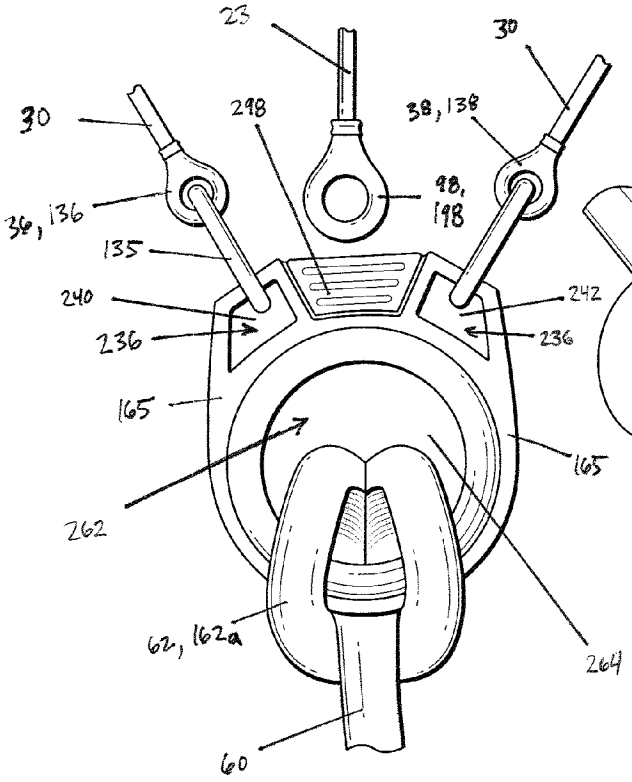
FIG. 11 is a top perspective partial assembly view of the mooring device link, according to one embodiment of the invention.

In an embodiment of the present invention the cleat strap 20 may comprise a cord 60 having one or more link connectors 162*a*, 162*b* at opposing ends whilst the cleat catch assembly 262 comprises a cleat aperture 264. As shown in FIGS. 10 and 11, one link connector 162*b* may optionally be wrapped around the cleat aperture 264 before being passed through the link connector 162*a* so as to secure the cleat strap cord 60 to both the link 165 and a cleat on an associated boat. In still other versions, the link connector 162*a* may be connected to the cleat aperture 264 via a clip 180, or the cleat catch assembly 262 itself may consist of a carabineer style clip adapted to releasably secure an associated cleat strap 20.

In one embodiment, the mooring catch assembly 236 may consist of one or more mooring apertures 240, 242 capable of securing an associated link connector 136, 138. In one version, the link connectors 136, 138 may optionally be connected to the mooring aperture, or apertures, 240, 242 via a carabineer style clip 135. In another embodiment, shown in FIG. 17, the mooring catch assembly 236 may consist of one or more carabineer style clips 135 that are integral to the link 165 and are adapted to secure an associated link connector 136, 138.

Figure 12:
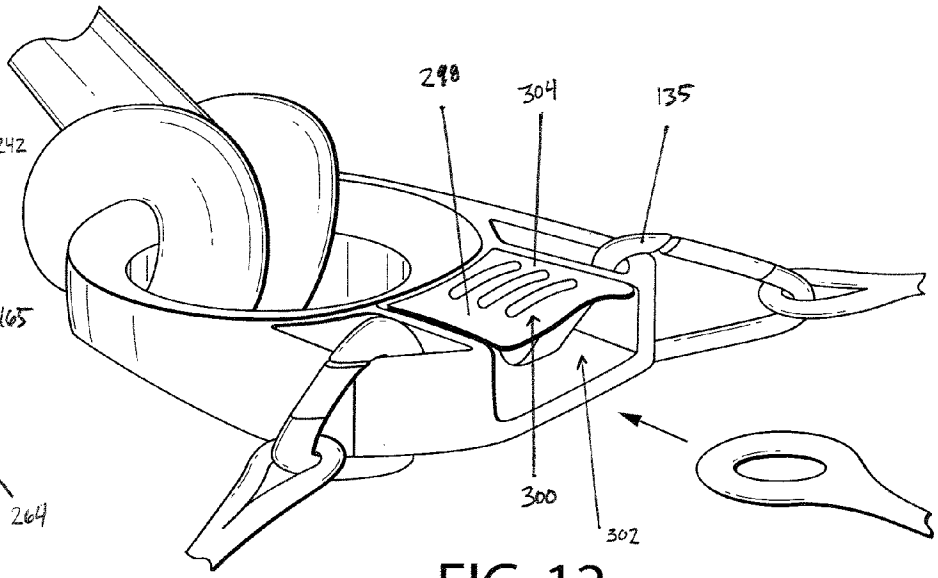
FIG. 12 is another perspective partial assembly view of the mooring device link, according to one embodiment of the invention.

Additionally, the fender catch assembly 298 of the invention may take various forms. In one embodiment, shown in FIGS. 11 and 12, the fender catch assembly 298 may comprise a latch assembly 300 adapted to releasably secure a link connector 198 from an associated fender 90. The latch assembly 300 shown in FIGS. 11 and 12 consists of a cavity 302 in the link 165 configured to receive an associated link connector 198, wherein the link connector 198 is inserted until secured by a biased latch 304. The latch 304 shown in FIGS. 11 and 12 is a hinged a two-piece version having a tooth 306 configured to be seated at least partially within, and engage, the link connector 198 upon its insertion into the cavity 302 in a fashion that releasably secures the fender 90 to the link 165. It should be understood, however, that the latch 304 may be a living hinge or other such biased latch assembly that might be selected by a person of sound engineering judgment.

Figure 13:
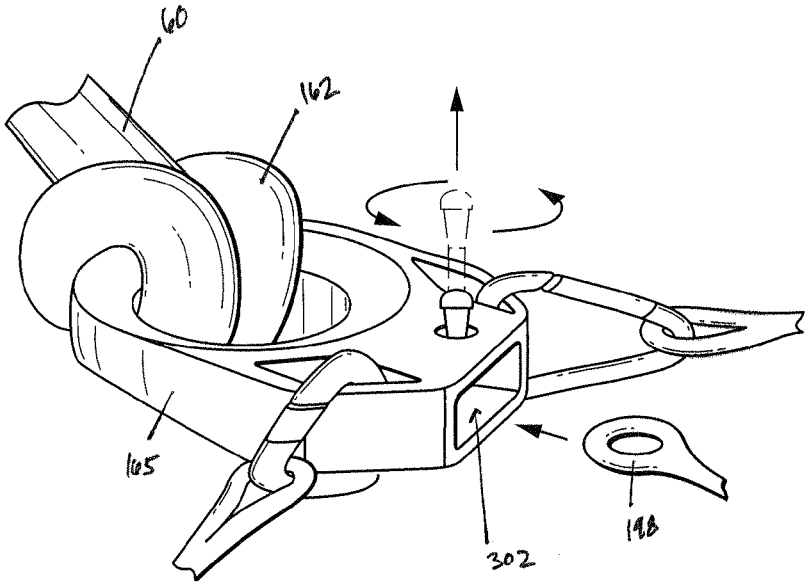
FIG. 13 is a perspective partial assembly view of the mooring device link, according to one embodiment of the invention.
Figure 14:
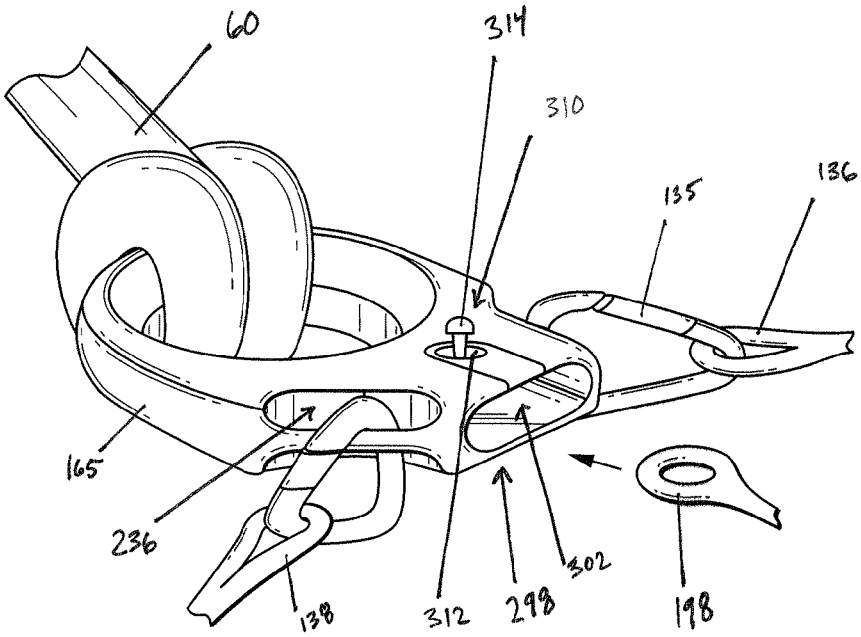
FIG. 14 is another perspective partial assembly view of the mooring device link, according to one embodiment of the invention.
Figure 16:
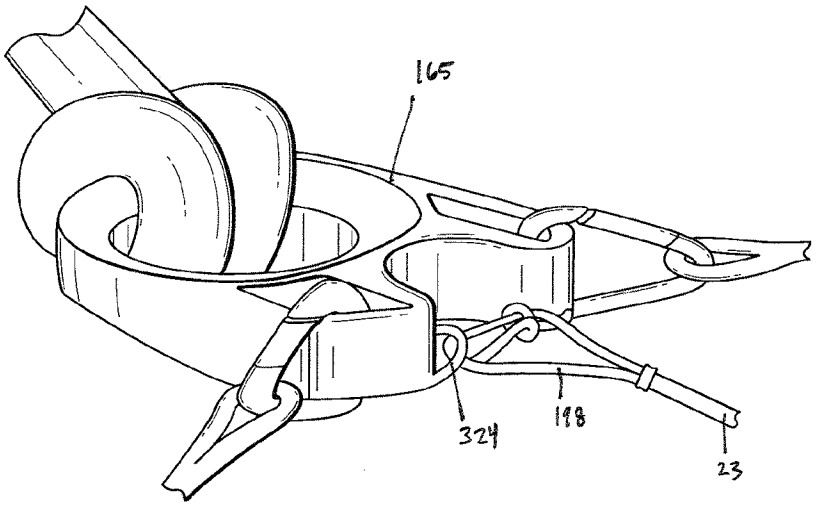
FIG. 16 is a perspective assembled view of the mooring device link, according to one embodiment of the invention.
Figure 15:
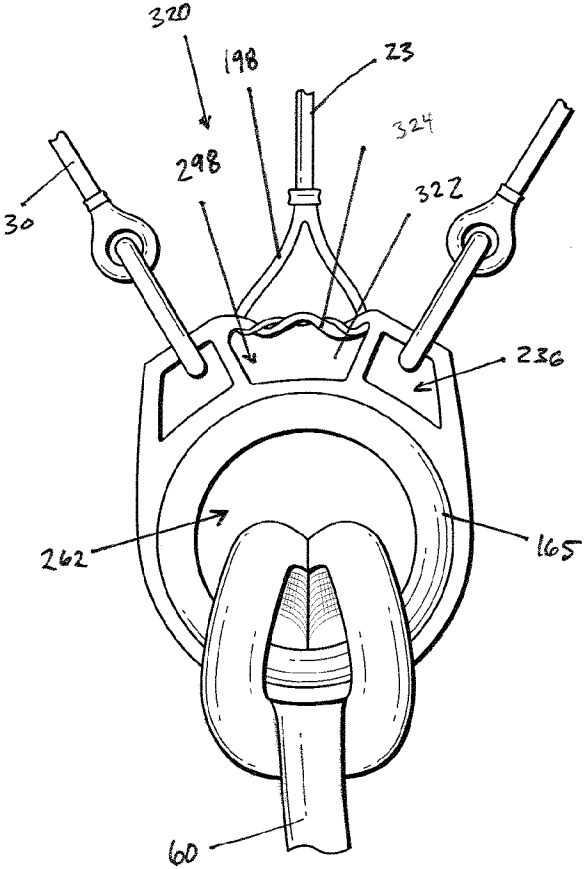
FIG. 15 is a top perspective assembled view of the mooring device link, according to one embodiment of the invention.

In another embodiment, the fender catch assembly 298 may consist of a pin assembly 310 adapted to releasably secure a link connector 198 from an associated fender 90. As shown in FIGS. 13 and 14, the pin assembly 310 may comprise a cavity 302 and pin aperture 312 in the link 165; the cavity being configured to receive an associated link connector 198; wherein the link connector 198 is inserted until secured by a pin 314 residing at least partially within the pin aperture 312. The pin assembly shown in FIGS. 13 and 14 utilizes a rotatable screw type pin 314, but it is to be understood that the pin 314 may be a snap-fit type design or other such configuration as might be selected by a person of sound engineering judgment.

In yet another embodiment, the fender catch assembly 298 may consist of a clasp assembly 320. The clasp assembly 320 may consist of an aperture 322 in the link 165 that is defined by a clasp 324; the aperture 322 and clasp 324 together being configured to receive and releasably secure an associated link connector 198. In the version shown in FIGS. 15 and 16, the clasp 324 may be partially cork-screwed in shape and configured to releasably secure the link connector 198 in much the same way a basketball net is threaded through similar clasps on a basketball rim; the link connector 198 being first inserted into the aperture 322 before being wrapped around a curved portion of the clasp 324. Although the version of the clasp 324 shown in the attached figures is of the basketball-style variety, it is to be understood that any clasp capable of securing an associated link connector 198 in a wrap-around fashion is intended to be included within the scope of the invention.

Figure 19:
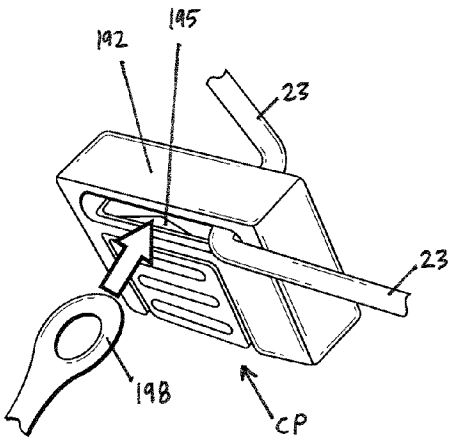
FIG. 19 is partially assembled perspective view of the fender linkage assembly, according to one embodiment of the invention.
Figure 20:
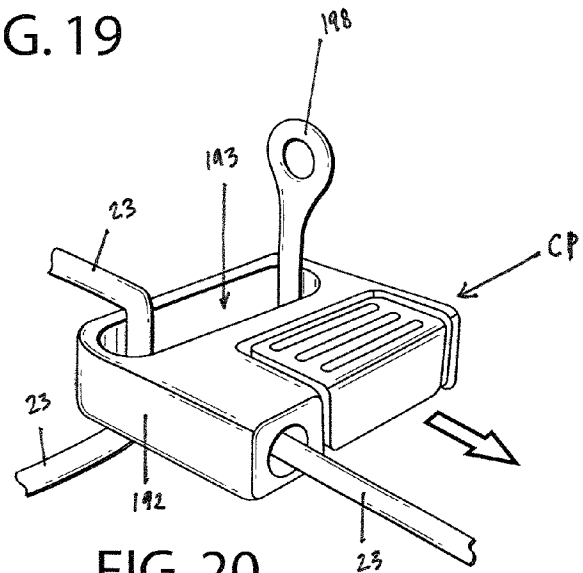
FIG. 20 is a fully-assembled perspective view of the fender linkage assembly, according to one embodiment of the invention.
Figure 18:
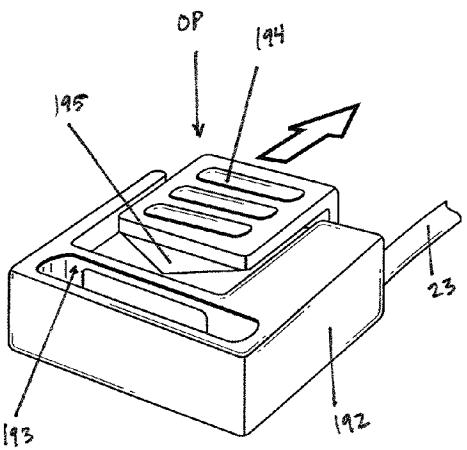
FIG. 18 is a perspective view of the fender linkage assembly, according to one embodiment of the invention.
Figure 17:
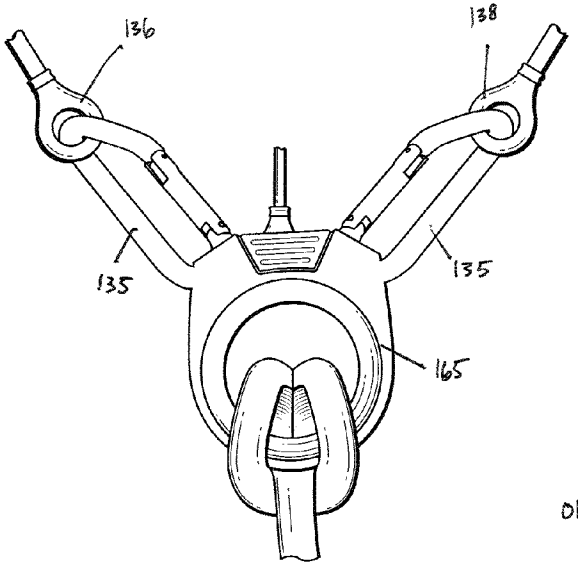
FIG. 17 is another perspective view of the mooring device link, according to one embodiment of the invention.
Figure 23:
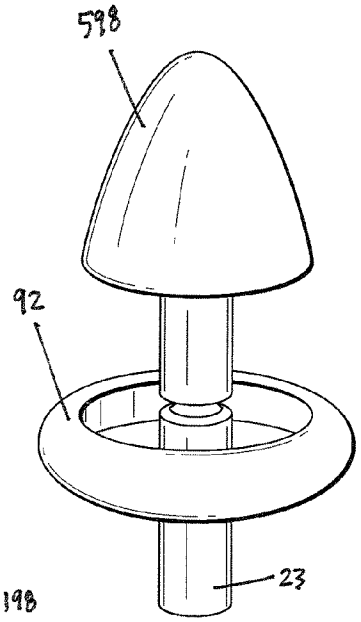
FIG. 23 is a perspective view of the fender's rubber stopper assembly.
Figure 22:
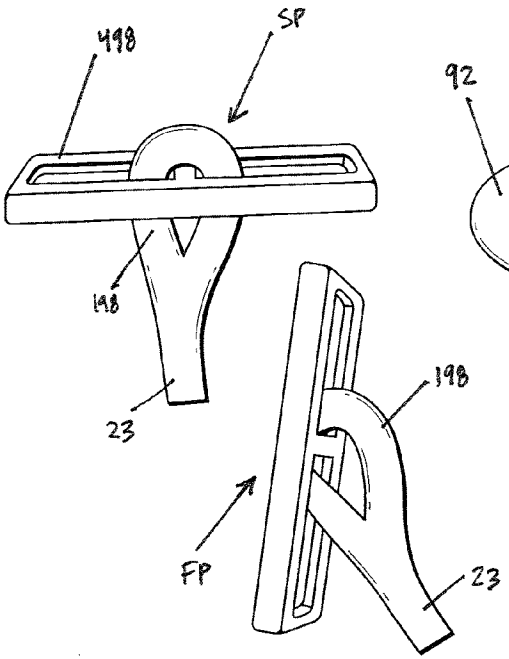
FIG. 22 is perspective views of the fender's toggle buckle assembly.
Figure 21:
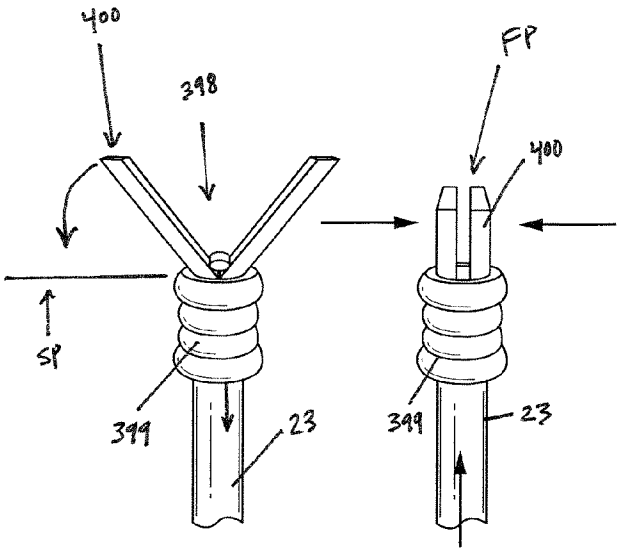
FIG. 21 is perspective views of the fender's sliding collar assembly.

In another embodiment, the fender cord 23 may be secured to the fender 90 in substantially the same axial and radial wrap configuration previously described herein, but where the ring 92 is replaced with a fender linkage assembly 192. As shown in FIGS. 18-20, the fender linkage assembly 192 may consist of a device adapted to releasably secure the fender cord 23 in a fixed position once it is installed around the fender 90. In one embodiment, shown in FIG. 20, the fender linkage assembly 192 may have a receiving slot 193 and a retractable tensioning bar 194 with a pinch protrusion 195; the retractable tensioning bar 194 being adapted to move between an open position OP permitting the fender cord 23 to pass through the receiving slot 193, and a closed position CP where the pinch protrusion 195 engages the fender cord 23 into a releasably fixed position within the receiving slot 193 and about the fender 90. In this version, the fender cord 23 may have a link connector 198 at a first end and a second end permanently anchored to, or within, the fender linkage assembly 192; in still other embodiments, not shown, the fender cord 23 may have a pair of link connectors 198*a*, 198*b* at opposing ends. As can be appreciated with reference to FIGS. 9 and 20, the fender cord 23 may be secured to the fender 90 by a method comprising the steps of: (1) moving the retractable tensioning bar 194 into an open position OP; (2) wrapping the fender cord 23 radially around the fender 90; (3) passing the fender cord 23 through the fender linkage assembly 192 receiving slot 193; (4) wrapping the fender cord 23 axially around the fender 90 through the aperture 88; (5) passing the fender cord 23 through the receiving slot 193 of the fender linkage assembly 192 a second time; and (6) moving the retractable tensioning bar 194 into a closed position CP which fixes the fender cord 23 in a locked position. Although this embodiment has been described in detail, it is to be understood that the fender linkage assembly may take other shapes and forms which are configured to lock the fender cord 23 into a fixed position about the fender without departing from the spirit and scope of the invention.

In still other embodiments, the fender linkage assembly 192 may comprise a ring 92—adapted for operative attachment to the link 165 or other centralized securement component—but the link connector 198 is replaced, or supplemented, with various components configured to secure the fender cord 23 in a substantially fixed position around the fender 90. For example, in one embodiment, generally shown in FIG. 21, the fender cord 23 may have a second end attached to the ring 92 and a first end comprising a sliding collar assembly 398 at one end comprising a collar 399 and arms 400*a*, 400*b*; the collar 399 and arms 400*a*, 400*b* being adapted to move between a first position FP wherein the fender cord 23 is configured to be threaded through the fender aperture 88 and ring 92 so as to secure the cord around the fender 90 in the aforementioned radial/axial arrangement, and a second position SP wherein the collar 399 is moved so that the arms 400*a*, 400*b* are releasably locked into a "T" position impeding retreat of the fender cord 23 back through the ring 92. In another embodiment, shown in FIG. 22, the fender cord 23 may have a second end attached to the ring 92 and a first end comprising a link connector 198 secured around a toggle buckle 498; the fender cord 23 and toggle buckle 498 being adapted to be moved between a first position FP where they are threaded through the fender aperture 88 and ring 92 so as to secure the fender cord 23 around the fender 90 in the aforementioned radial/axial arrangement, and a second position SP wherein the toggle buckle 498 is moved into a "T" position impeding retreat of the fender cord 23 back through the ring 92. In yet other embodiments, generally shown in FIG. 23, the fender cord 23 may have fender cord 23 may have a second end attached to the ring 92 and a first end comprising a rubber stopper assembly 598 that is configured to be threaded through the fender aperture 88 and ring 92 so as to secure the fender cord 23 around the fender 90 in the aforementioned radial/axial arrangement, but is otherwise adapted to impede retreat back through the ring 92.

Figure 24:
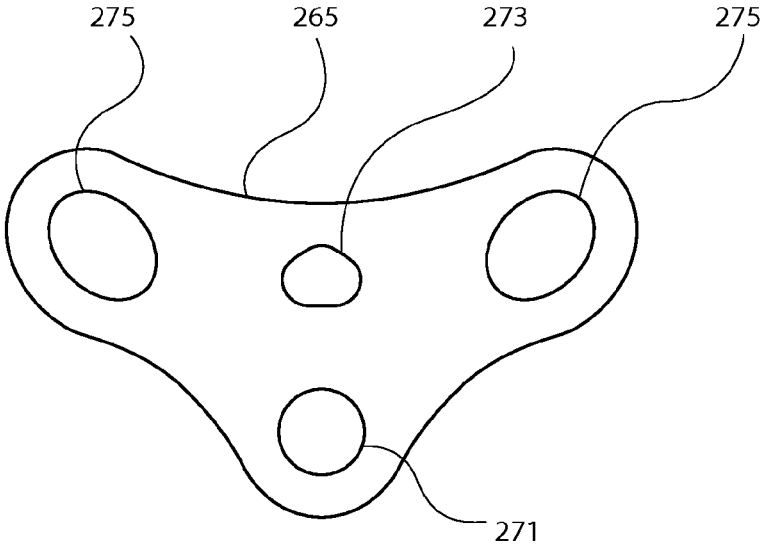
FIG. 24 is a perspective view of an another link for use with a portable water level-responsive mooring device.
Figure 25:
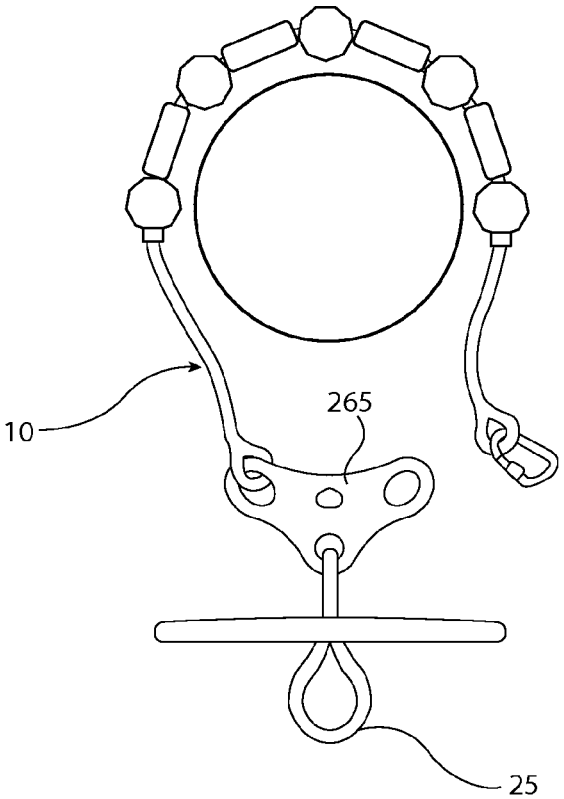
FIG. 25 is a top view of the link of FIG. 24 in use with an exemplary portable water level-responsive mooring device.

In yet another embodiment, illustrated in FIGS. 24 and 25, the link 265 is a composite ring with discrete portions adapted to receive link connectors from the mooring strap 10, the fender 90, and/or the cleat strap 20. The link 265 includes a cleat connector receiving aperture 271, a fender connector receiving aperture 273, and two mooring connector receiving aperture 275 adapted to receive the respect link connectors. In some embodiments, the link connectors may be clips, such as carabiner style clips or other releaseable and/or lockable clips as discussed above. In other embodiments, one of the link connectors may be integrally connected to the link 265. For example, the link 265 may be integrally connected to the mooring strap 10 with a loop, such that the link and mooring strap form an assembly usable in combination with the fender 90 and/or cleat strap 25. A link such as those disclosed may further improve the utility of the presently disclosed systems by providing a discrete position for each connection and reducing incidents of tangled straps or connectors.

While the dock securing device and system has been described with detailed reference to one or more embodiments, the disclosure is to be considered as illustrative and not restrictive. Modifications and alterations will occur to those skilled in the art upon a reading and understanding of this specification. It is intended to include all such modifications and alterations in so far as they come within the scope of the claims, or the equivalence thereof.

What is claimed is:

1. A portable water level-responsive mooring device comprising:

a mooring strap comprising a length of mooring cord having a link connector on each end, a plurality of spacing tubes, and a plurality of rollers having an outer diameter greater than the outer diameter of the spacing tubes and an inner diameter larger than the outer diameter of the mooring cord, wherein the spacing tubes and the rollers are alternatingly arranged between the ends of the mooring cord, and wherein the mooring cord is positioned within respective apertures of the spacing tubes and the rollers, the length of the mooring cord being sufficient to wrap around a dock piling;

a fender having a link connector; and a link, comprising a cleat catch portion adapted to secure a link connector from an associated cleat strap, a mooring catch portion adapted to secure at least one link connector from the mooring strap, and a fender catch portion adapted to secure the link connector of the fender.

2. The device of claim 1 further comprising:

a cleat strap comprising a cord having a loop at one end configured for engaging a boat cleat and a link connector at an opposite end of the cord.

3. The device of claim 1, wherein the cleat catch portion comprises a cleat aperture.

4. The device of claim 3, wherein the mooring catch portion comprises at least one mooring aperture.

5. The device of claim 4, wherein the mooring catch portion further comprises at least one clip.

6. The device of claim 3, wherein the mooring catch portion comprises at least one clip integral to the link.

7. The device of claim 3, wherein the fender catch portion comprises a latch assembly.

8. The device of claim 3, wherein the fender catch portion comprises a pin assembly.

9. The device of claim 6, wherein the fender catch portion comprises a clasp assembly.

10. The device of claim 3, wherein the cleat catch portion further comprises at least one clip.

11. The device of claim 1, wherein the cleat catch portion comprises a cleat connector receiving aperture, the fender catch portion comprises a fender connector receiving aperture, and the mooring catch portion comprises a pair of mooring connector receiving apertures.

12. The device of claim 1, wherein the fender further comprises:

a cord-receiving aperture;

a fender linkage assembly; and a fender cord, wherein the cord has a link connector at a first end and a second end permanently anchored to the fender linkage assembly, and the cord is wrapped radially around the fender, passed through the fender linkage assembly, wrapped axially around the fender through the aperture, and passed through fender linkage assembly a second time.

13. The device of claim 12, wherein the fender linkage assembly comprises:

a retractable tensioning bar with a pinch protrusion;

and a receiving slot;

wherein the retractable tensioning bar is adapted to move between an open position permitting the fender cord to pass through the receiving slot, and a closed position where the pinch protrusion engages the cord into a releasably fixed position within the receiving slot and around the fender.

* * * * *